US011505362B2

(12) United States Patent
Wikstrom

(10) Patent No.: US 11,505,362 B2
(45) Date of Patent: Nov. 22, 2022

(54) TAMPER-EVIDENT CONTAINER LOCK

(71) Applicant: Todd Wikstrom, Las Vegas, NV (US)

(72) Inventor: Todd Wikstrom, Las Vegas, NV (US)

(73) Assignee: Pizza Spice Packet LLC

( * ) Notice: Subject to any disclaimer, the term of this patent is extended or adjusted under 35 U.S.C. 154(b) by 0 days.

(21) Appl. No.: 17/379,023

(22) Filed: Jul. 19, 2021

(65) Prior Publication Data

US 2022/0017263 A1 Jan. 20, 2022

Related U.S. Application Data

(60) Provisional application No. 63/053,216, filed on Jul. 17, 2020.

(51) Int. Cl.

| | |
|---|---|
| ***B65D 5/54*** | (2006.01) |
| ***B65D 85/36*** | (2006.01) |
| ***B65D 5/66*** | (2006.01) |

(52) U.S. Cl.

CPC ..... *B65D 5/546* (2013.01); *B65D 5/6626* (2013.01); *B65D 85/36* (2013.01); *B65D 2585/366* (2013.01)

(58) Field of Classification Search

CPC ..... B65D 85/36; B65D 5/6626; B65D 5/546; B65D 2585/366; B65D 5/6608; B65D 5/0254; B65D 5/106; B65D 2571/0016; B65D 2571/00228; Y10S 206/807; B31B 50/732

USPC ..... 229/102, 155, 158, 149, 150, 195, 126, 229/156, 188; 206/807

See application file for complete search history.

(56) References Cited

U.S. PATENT DOCUMENTS

| | | | | |
|---|---|---|---|---|
| 1,108,464 A * | 8/1914 | Morey | B65D 5/0254 229/149 |
| 3,356,282 A * | 12/1967 | Layne, Sr. | B65D 5/5014 206/424 |
| 4,279,377 A | 7/1981 | Peeples | |
| 4,386,729 A | 6/1983 | Schmidt | |
| 4,600,140 A * | 7/1986 | Milliens | B65D 71/12 206/427 |
| 4,830,270 A * | 5/1989 | Holmes | B65D 5/0254 229/102 |

(Continued)

FOREIGN PATENT DOCUMENTS

| | | |
|---|---|---|
| CA | 2211168 C | 7/2001 |
| DE | 2804211 A1 | 8/1979 |
| GB | 932477 A | 7/1963 |

*Primary Examiner* — Christopher R Demeree

(74) *Attorney, Agent, or Firm* — QuickPatents, LLC; Kevin Prince

(57) ABSTRACT

A locking arrangement for a container that has a lid pivotally attached with a base includes a flap that is pivotally attached at a first end thereof to the lid at a peripheral edge of the lid. The flap has a tab projecting laterally away from a second end of the flap. A frangible portion of the lid is defined by a perforation that terminates to encompass the first end of the flap. A slot is formed through an upwardly-projecting peripheral wall of a base of the container. As such, with the lid of the container moving towards a closed position, and with the tab in a folded position, the flap and tab are inserted through the slot of the peripheral wall of the base, thereafter as the tab clears the slot the resilient material urges the tab into an expanded position to lock the container.

15 Claims, 20 Drawing Sheets

(56) References Cited

U.S. PATENT DOCUMENTS

| | | | | |
|---|---|---|---|---|
| 5,240,176 | A * | 8/1993 | Akers | B65D 5/566 220/908 |
| 5,350,108 | A | 9/1994 | Friar | |
| 5,853,121 | A * | 12/1998 | Francisco | B65D 5/2047 229/117.14 |
| 11,186,406 | B2 * | 11/2021 | Chapman | B65D 5/667 |
| 2008/0308616 | A1 | 12/2008 | Phung | |
| 2010/0252618 | A1 * | 10/2010 | Adam | B65D 5/6608 229/102 |
| 2014/0263600 | A1 | 9/2014 | Valencia | |
| 2019/0344927 | A1 | 11/2019 | Ozgercel | |
| 2022/0153510 | A1 * | 5/2022 | Bressan | B65D 85/36 |

* cited by examiner

TAMPER-EVIDENT CONTAINER LOCK

CROSS-REFERENCE TO RELATED APPLICATIONS

This application claims the benefit of U.S. Provisional Patent Application 63/053,216, filed on Jul. 17, 2020, and is incorporated herein by reference.

STATEMENT REGARDING FEDERALLY SPONSORED RESEARCH AND DEVELOPMENT

Not Applicable.

FIELD OF THE INVENTION

This invention relates to corrugated and fold-up containers, and more particularly to a tamper-evident lock for such containers.

BACKGROUND

Food delivery has become widely popular not only in the United States, but also globally in industrialized nations. The convenience of a pizza or other meal being delivered at home or at an office, however, is offset by the risks of releasing a food delivery to a delivery person, and thereby losing chain of custody. When the consumer receives his food, currently there is no easy way of determining if the food was tasted, picked at, or touched by the delivery person. This is true whether or not the delivery person is an employee of the food supplier. With the advent of third-party delivery services such as Uber Eats, Grubhub, and the like, there is an even greater need to seal food containers in a tamper-evident manner so that the consumer can easily determine if his food has been tampered with.

Simply taping the food container shut with adhesive tape or stickers is ineffective since hot containers often allow the tape adhesive to be easily released, particularly if steam is generated by hot food items within the container. Further, tape may be misapplied or ill-applied by a restaurant worker, as there is no guarantee that the tape has stuck properly to the container other than by attempting to open the container manually and continuing to press the tape against the container to ensure the adhesive has properly bonded to the container, which is time consuming.

Wrapping food containers in a bag and stapling the bag shut is a solution that can be overcome quickly by deliver people who carry a spare stapler in their delivery vehicle. Heat sealing the bag is time consuming, requires bags that are heat-sealable, and also requires equipment at the restaurant for sealing the bag, all of which make this a costly option.

Therefore, there is a need for a pizza box or other food container that can be quickly locked in a tamper-evident fashion. Such a needed invention would allow the user to simply fold a locking element that is formed with the lid of the container through a front or side slot of the container to seal the container, and would require the container to be torn or broken in an evident manner to be opened. Such a needed invention would be relatively inexpensive to manufacture, intuitive to use, and provide a visual confirmation that the container is locked, has never been locked, or was locked and then opened. Further, such a needed invention would inhibit any pieces of the container from becoming separated from the container. The present invention accomplishes these objectives.

SUMMARY OF THE INVENTION

The present device is a locking arrangement for a container having a lid with at least one peripheral edge. The lid is attached with a base that includes at least one upwardly-projecting peripheral wall that has an outside surface and an inside surface. The container may be a pizza box, a cardboard box, or other container made with a resilient material, such as cardboard, or the like.

A flap is pivotally attached at a first end thereof to the lid at the at least one peripheral edge of the lid. The flap has a tab projecting laterally away from a second end of the flap. The tab is movable between an expanded position and a folded position. A frangible portion of the lid is defined by a perforation that terminates to encompass the first end of the flap.

A slot is formed through the at least one upwardly-projecting peripheral wall of the container. Preferably the lid is attached to the base at a rear peripheral edge thereof, and the flap, tab and frangible portion are formed at a front peripheral edge of the lid. As such, the slot is formed in the front upwardly-projecting peripheral wall and corresponds with the location of the tab for insertion of the tab therein.

As such, in use, with the lid of the container moving towards a closed position, and with the tab in the folded position, the flap and tab are inserted through the slot from the outside surface of the peripheral wall through to the inside surface of the peripheral wall, thereafter as the tab clears the slot the resilient material urges the tab into the expanded position. A width of the flap and tab is greater than a width of the slot, preventing subsequent removal of the flap and tab from the slot. The container lid is openable when the frangible portion of the lid is separated from the lid at the perforation. The frangible portion, flap and tab are captured by the slot as the lid is opened.

In some embodiments, the at least one upwardly-projecting wall is a folded peripheral wall that has an outside section, an upper edge section, and an inside section. In such an embodiment, an aperture is formed through the inside section that allows the tab to expand therethrough when clearing the slot that is formed through the outside section.

As such, the flap and tab are prevented from being pulled back out of the slot since the tab catches on the inside section of the folded peripheral wall.

Similarly, other embodiments, also having the folded peripheral wall and the aperture, include the slot formed through the upper edge section, wherein after insertion through the slot, again the flap and tab are prevented from being pulled back out of the slot since the tab catches on the inside section of the folded peripheral wall.

In some embodiments, the container may include two or more of the locking arrangements, a first of the locking arrangements shown in a locked position to lock the box lid in the closed position, the additional locking arrangements tucked inside the box for future use. Such a second of the locking arrangements is useful when, for example, upon delivery of food items wherein the first of the locking arrangements is locked, and upon opening of the container and eating a portion of the food items, the second of the locking arrangements may be engaged with the slot to subsequently lock the box a second time, so as to prevent roommates or others from accessing the leftover food items of the box without leaving evidence of such, which includes the detached frangible portion of the second of the locking arrangements.

The present invention is a pizza box or other food container that can be quickly locked in a tamper-evident fashion. The present arrangement allows the user to simply fold a locking element that is formed with the lid of the container through a front or side slot of the container to seal the container, and requires the container to be torn or broken in an evident manner to be opened, preferably at a frangible area designed to release the locking tab and flap from the lid of the container. The present invention is relatively inexpensive to manufacture, intuitive to use, and provides a visual confirmation that the container is locked, has never been locked, or was locked but is now open. Further, the present arrangement inhibits any pieces of the container from becoming separated from the container, reducing the chance of a choking hazard being inadvertently dropped onto a pizza or other food item. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Figure 1:
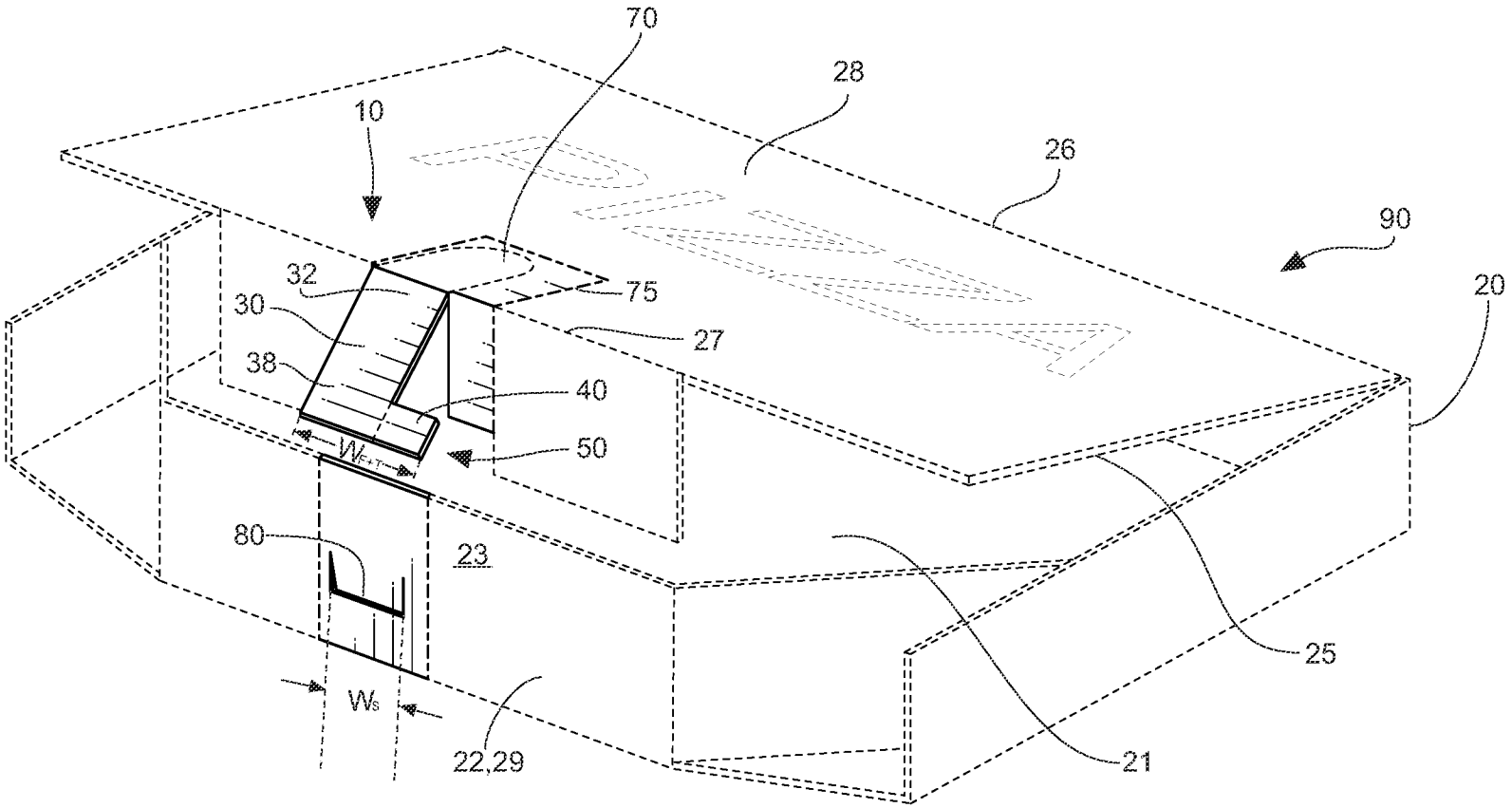
FIG. 1 is a perspective view of a first embodiment of the invention, illustrating a container with a lid in an open position.
Figure 2:
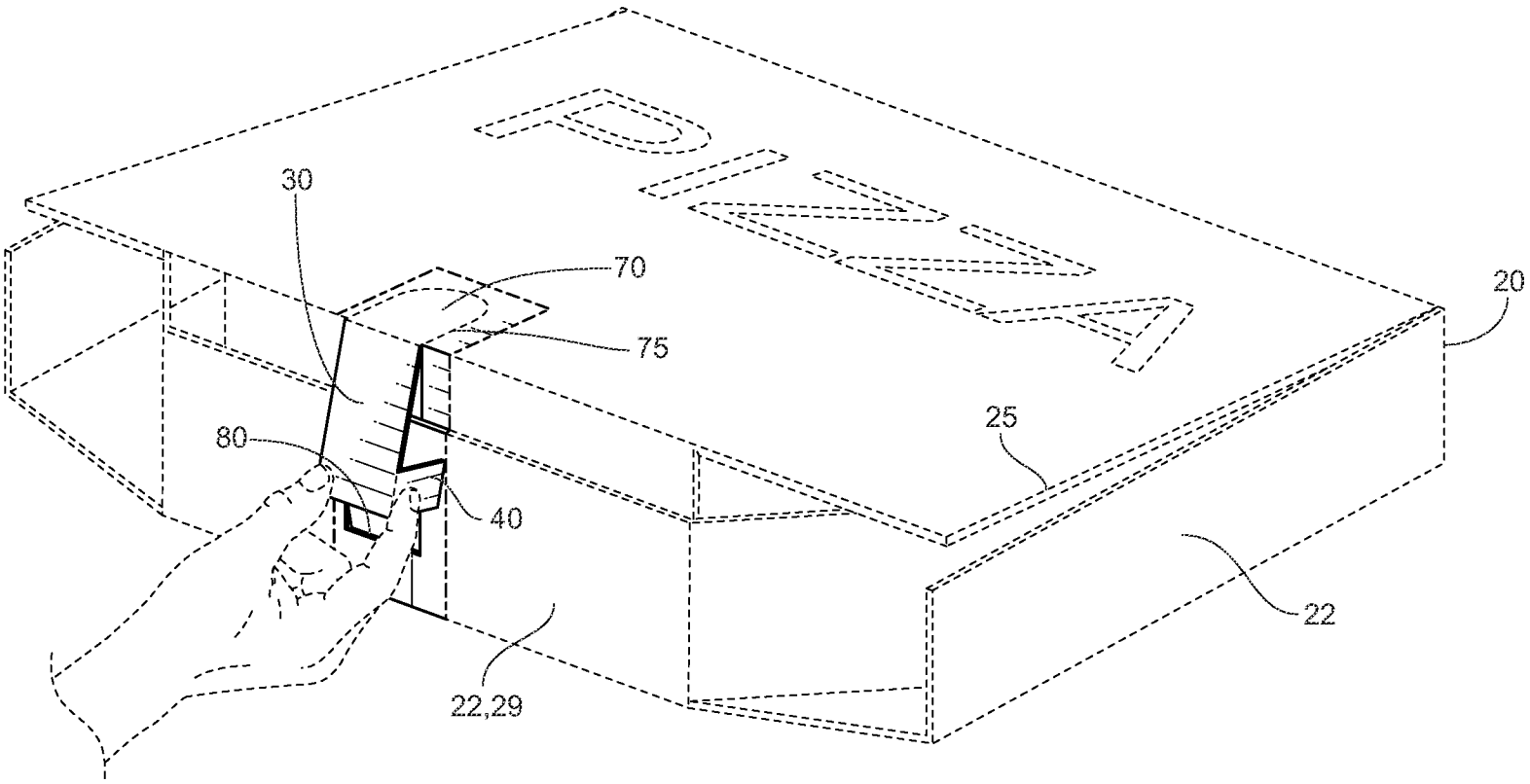
FIG. 2 is a perspective view of the embodiment of FIG. 1, illustrating a person folding a tab of a flap inwardly so as to be able to be inserted into a slot in a front wall of a base of the container.
Figure 3:
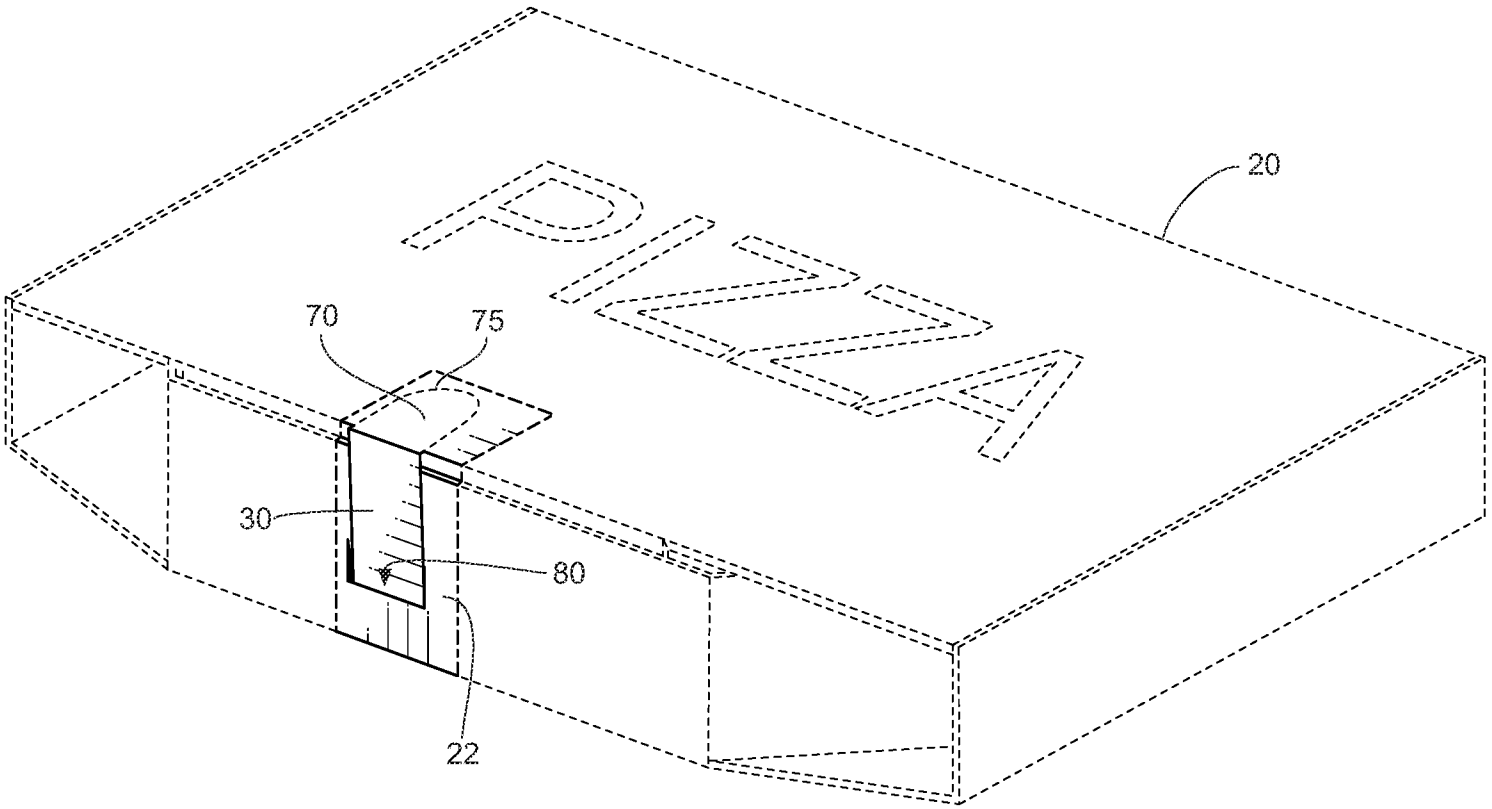
FIG. 3 is a perspective view of the embodiment of FIG. 1, illustrating the flap and tab as fully inserted into the slot to lock the container in a closed position.
Figure 4:
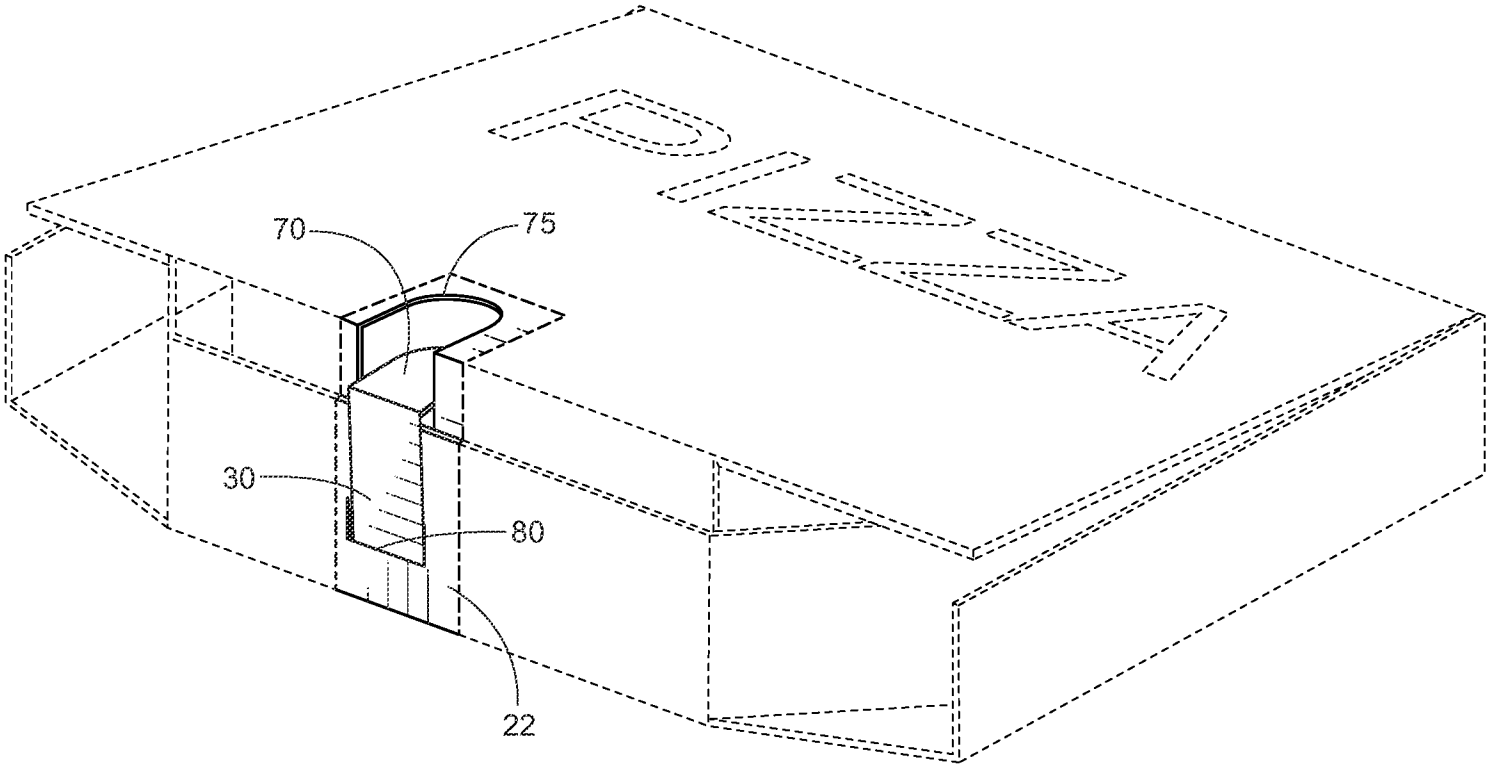
FIG. 4 is a perspective view of the embodiment of FIG. 1, illustrating a frangible portion after separation thereof at a perforation thereof from the lid of the container, allowing the lid to be opened and leaving evidence that the container was opened after it was previously locked.

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

FIGS. 1-6 illustrate a locking arrangement 10 for a box or container 20 having a lid 28 with at least one peripheral edge 25. The lid 28 is attached with a base 21 that includes at least one upwardly-projecting peripheral wall 22 that has an outside surface 23 and an inside surface 24. The container 20 may be a pizza box 90 (FIGS. 1-9), a cardboard box 20 (FIGS. 10-11), or other container 20 made with a resilient material, such as cardboard, paperboard or card stock material, vinyl sheet material, paper sheet material, resilient plastic, or the like. Preferably the base 21 includes at least four of the upwardly-projecting peripheral walls 22, with one being a rear peripheral wall, a front peripheral wall 29, and two side peripheral walls. Other shapes of the container are also able to utilize the locking arrangement 10, such as round containers that are circular front a top plan view and only having a single cylindrical peripheral wall 22, hexagon-shaped containers having six of the upwardly-projecting peripheral walls 22, and the like.

The locking arrangement 10 is preferably formed with the container 20, which is typically die-cut from a web of the resilient material. The locking arrangement 10 may be formed at the same time as the container 20, preferably, or after the formation of the container 20 by a subsequent cutting operation.

A flap 30 is pivotally attached at a first end 32 thereof to the lid 28 at the at least one peripheral edge 25 of the lid 28. The flap 30 has a tab 40 projecting laterally away from a second end 38 of the flap 30. The tab 40 is movable between an expanded position 50 and a folded position 60. In the folded position 60, the tab 40 is folded backwardly or towards the inside of the container 20, such that when the tab 40 is released to snap back to the expanded position 50, it cannot be folded back into the folded position 60 from outside of the sealed container 20 since the lid 28 covers the flap 40.

Figure 5:
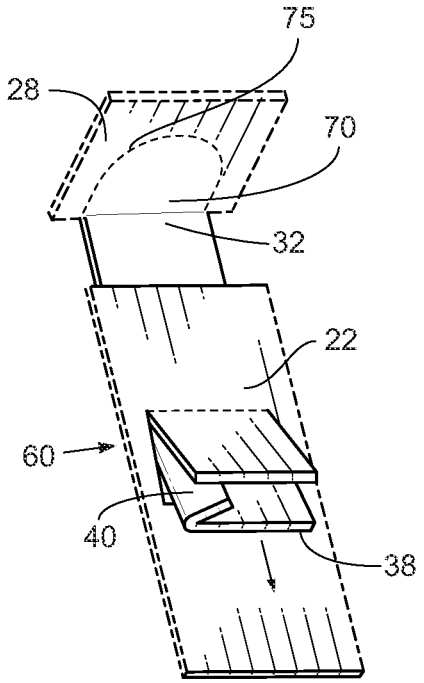
FIG. 5 is a partial rear view of the front wall of the base showing the tab in a folded position as inserted through the slot with the flap.
Figure 6:
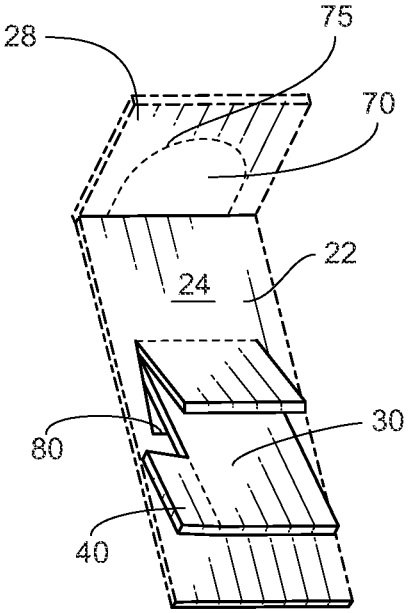
FIG. 6 is a partial rear view of the front wall of the base showing the tab in the expanded position once the flap and tab have been fully inserted through the slot, the tab expanding laterally from the flap to prevent subsequent removal of the flap from the slot.

A frangible portion 70 of the lid 28 is defined by a perforation 75 that terminates to encompass the first end 32 of the flap 30 (FIG. 5). The perforation 75 of the frangible portion 70 is preferably U-shaped as illustrated, or semi-circular in shape (not shown), or other suitable shape that indicates that a person 16 should depress the frangible portion 70 to detach the frangible portion 70 from the lid 28 to open the lid 28. A star-shape (not shown) for example may draw attention to the frangible portion 70, as well as suitable printed or otherwise-affixed indicia (not shown) on the container lid 28. Preferably the perforation 75 is such that it makes an audible "popping" sound when the frangible portion 70 is pressed down into the container 20 and the perforation 75 is separated, each perforation rupturing substantially simultaneously to make the popping sound.

A slot 80 is formed through the at least one upwardly-projecting peripheral wall 22 of the container 20. Preferably the lid 28 is attached to the base 21 at a rear peripheral edge 26 thereof, and the flap 30, tab 40 and frangible portion 70 are formed at a front peripheral edge 27 of the lid 28. As such, the slot 80 is formed in the front upwardly-projecting peripheral wall 29.

As such, in use, with the lid 28 of the container 20 moving towards a closed position (FIG. 3), and with the tab 40 in the folded position 60, the flap 30 and tab 40 are inserted through the slot 80 from the outside surface 23 of the peripheral wall 25 through to the inside surface 24 of the peripheral wall 25 (FIG. 5), thereafter as the tab 30 clears the slot 80 the resilient material urges the tab 30 into the expanded position 50. A width $W_{F+T}$ (FIG. 1) of the flap 30 and tab 40 is greater than a width $W_S$ of the slot 80, preventing subsequent removal of the flap 30 and tab 40 from the slot 80. The container lid 28 is openable when the frangible portion 70 of the lid 28 is separated from the lid 28 at the perforation 75. The frangible portion 70, flap 30 and tab 40 are captured by the slot 80 as the lid 28 is opened. In some embodiments, the tab 30 includes a wider waist area 160 (FIG. 10) that is wider than the width $W_S$ of the slot 80, thereby actively capturing the frangible portion 70, the flap 30, and the tab 40. The flap 30 may also include an indicia or text (not shown), such as "LOCKED," a locked padlock icon, or the like, to provide a quick visual indicator that the container 20 is locked.

Figure 7:
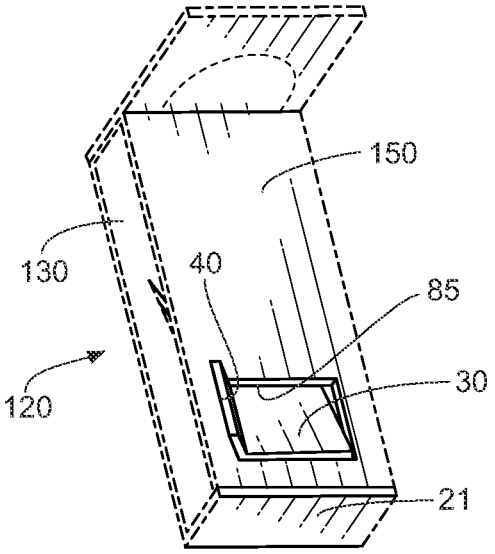
FIG. 7 is a perspective view of a second embodiment of the invention, wherein the front wall of the container is a folded peripheral wall having an outside section, an upper edge section, and an inside section.
Figure 8:
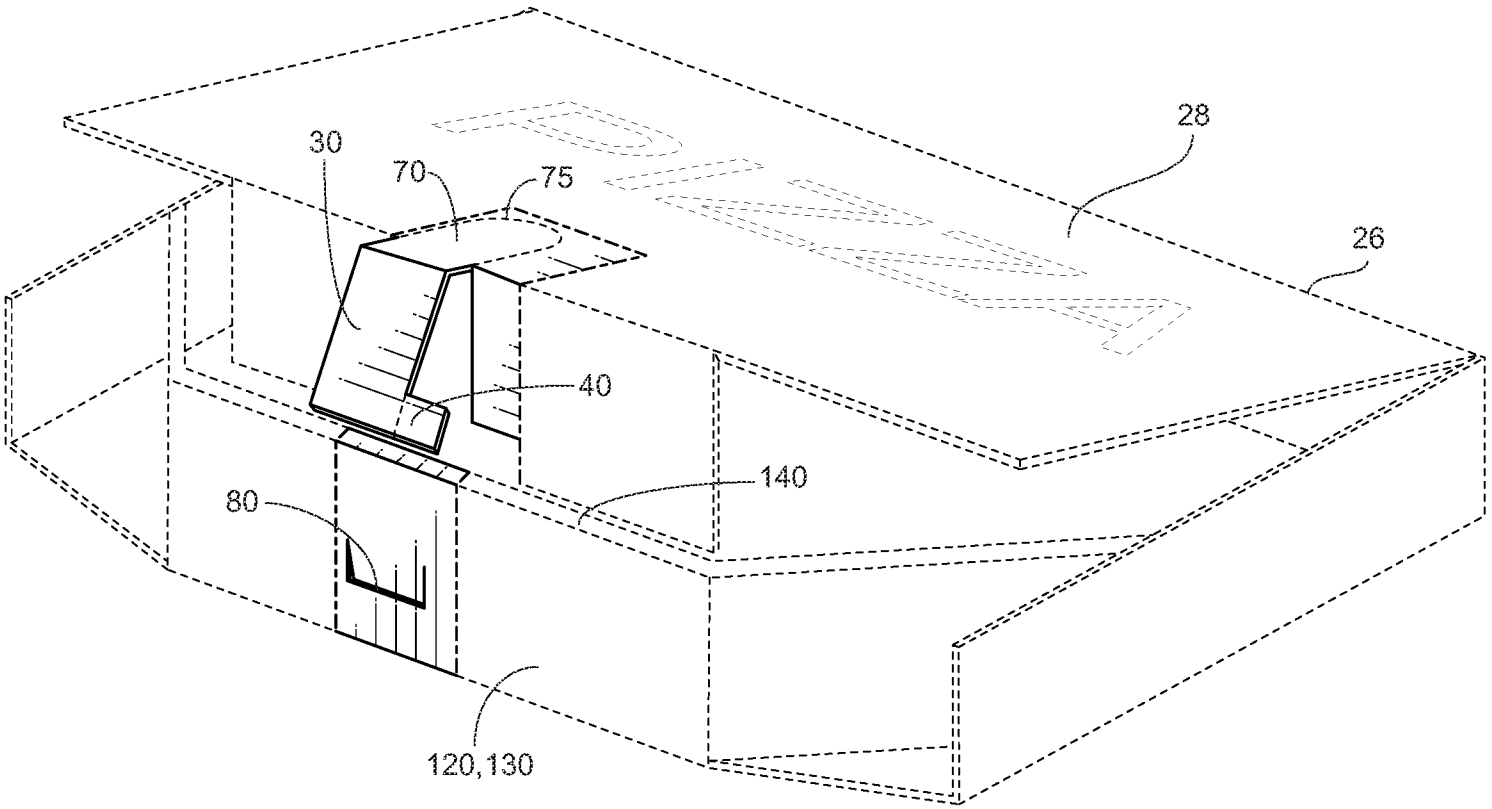
FIG. 8 is a partial rear view of the front wall of the base of FIG. 7, showing the tab in the expanded position once the flap and tab have been fully inserted through the slot, the tab expanding laterally from the flap and extending through an aperture of the inside section of the peripheral wall to prevent subsequent removal of the flap from the slot.
Figure 9:
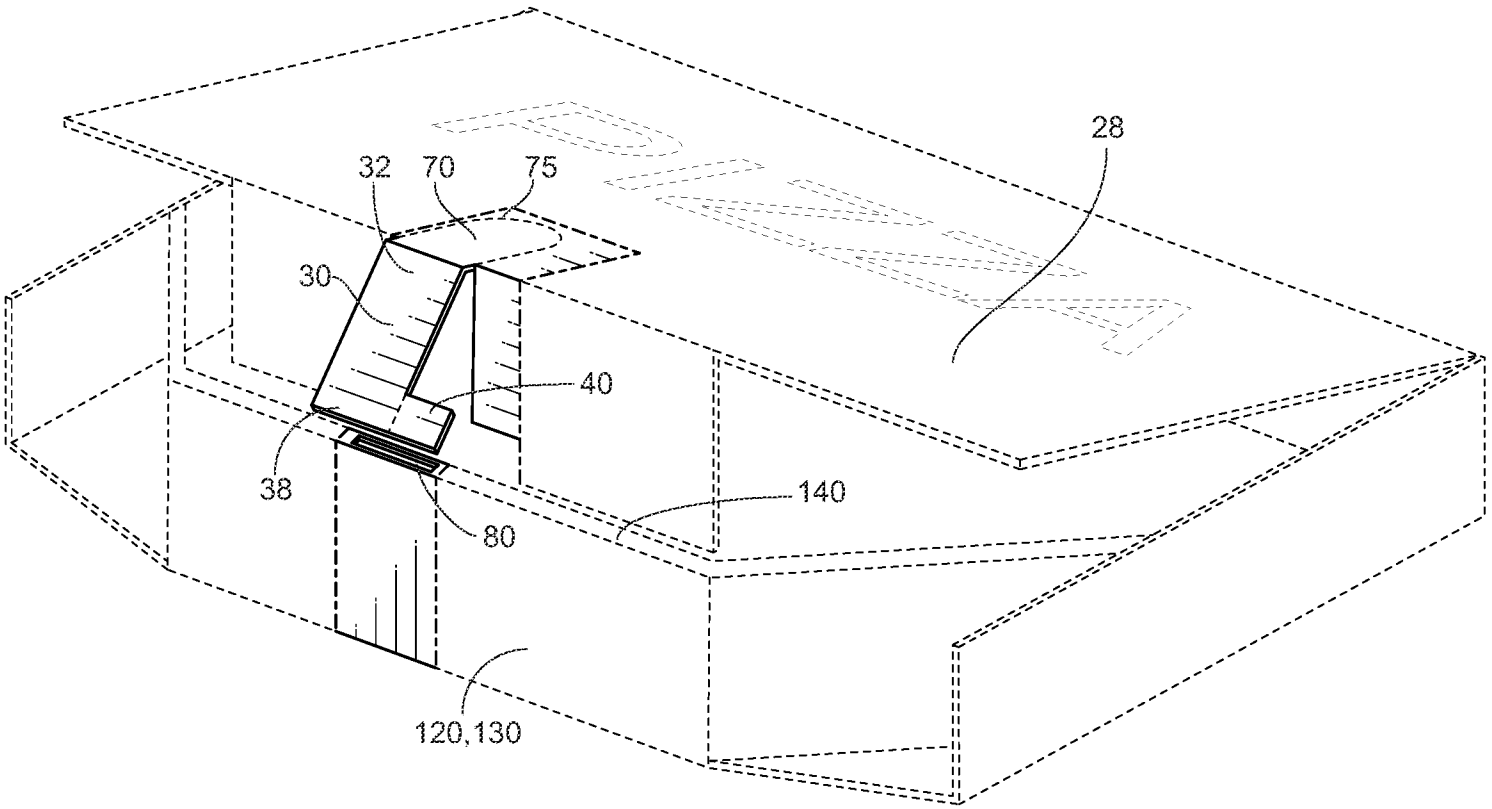
FIG. 9 is a perspective view of a third embodiment of the invention, wherein the front wall of the container is a folded peripheral wall having an outside section, an upper edge section, and an inside section, the slot formed in the upper edge section, the rear view of the third embodiment being identical to that shown in FIG. 8.

In some embodiments, illustrated in FIGS. 7 and 8, the at least one upwardly-projecting wall 22 is a folded peripheral wall 120 that has an outside section 130, an upper edge section 140, and an inside section 150. In such an embodiment, an aperture 85 is formed through the inside section 150 (FIG. 8) that allows the tab 40 to expand therethrough when clearing the slot 80 that is formed through the outside section 130. As such, the flap 30 and tab 40 are prevented from being pulled back out of the slot 80 since the tab 40 catches on the inside section 150 of the folded peripheral wall 120.

Similarly, other embodiments, also having the folded peripheral wall 120 and the aperture 85, include the slot 80 formed through the upper edge section 140 (FIG. 9), wherein after insertion through the slot 80, again the flap 30 and tab 40 are prevented from being pulled back out of the slot 80 since the tab 40 catches on the inside section 150 of the folded peripheral wall 120 (FIG. 8).

Figure 10:
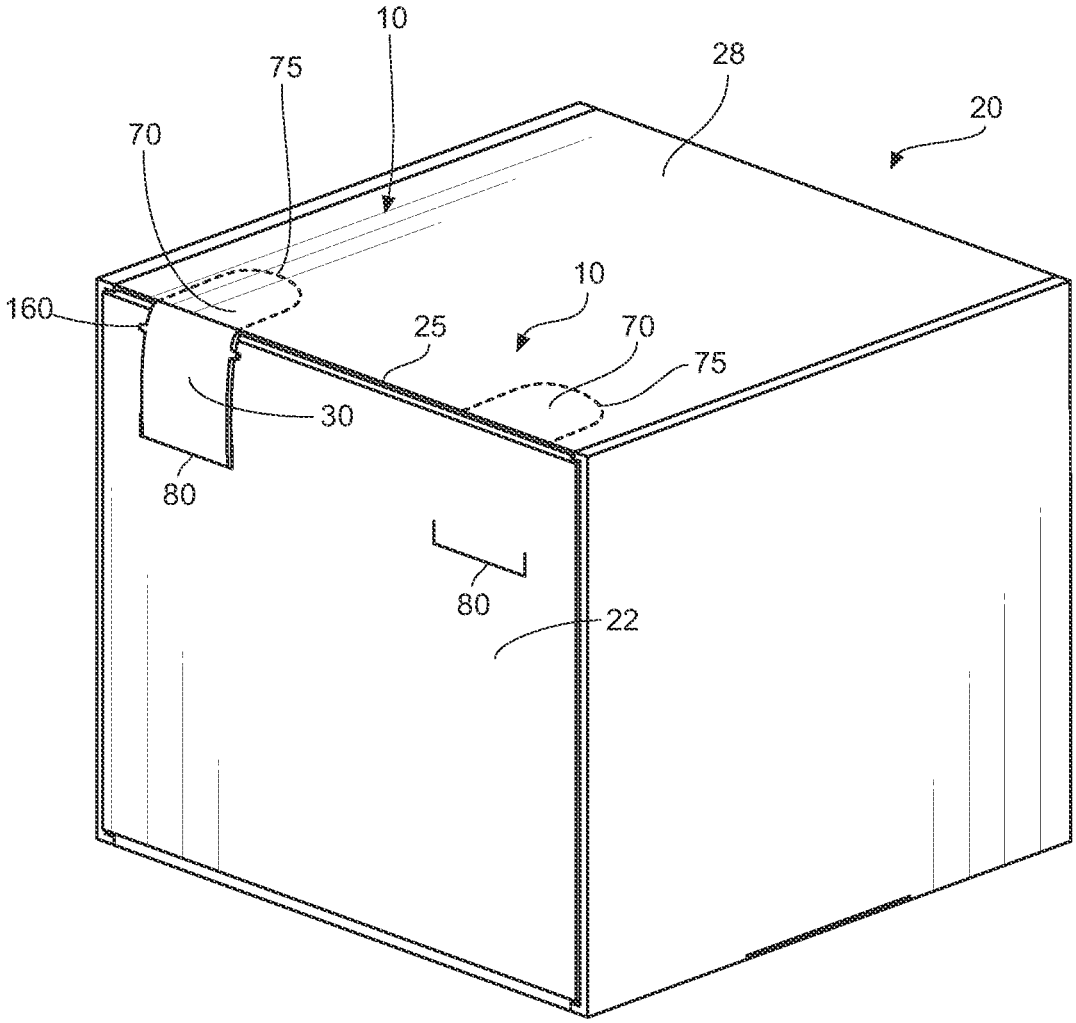
FIG. 10 is a perspective view of a forth embodiment of the invention, illustrating a container having two of the locking arrangements, a first of the locking arrangements shown in a locked position to lock the box lid in the closed position, a second of the locking arrangements shown tucked inside the box for future use.
Figure 11:
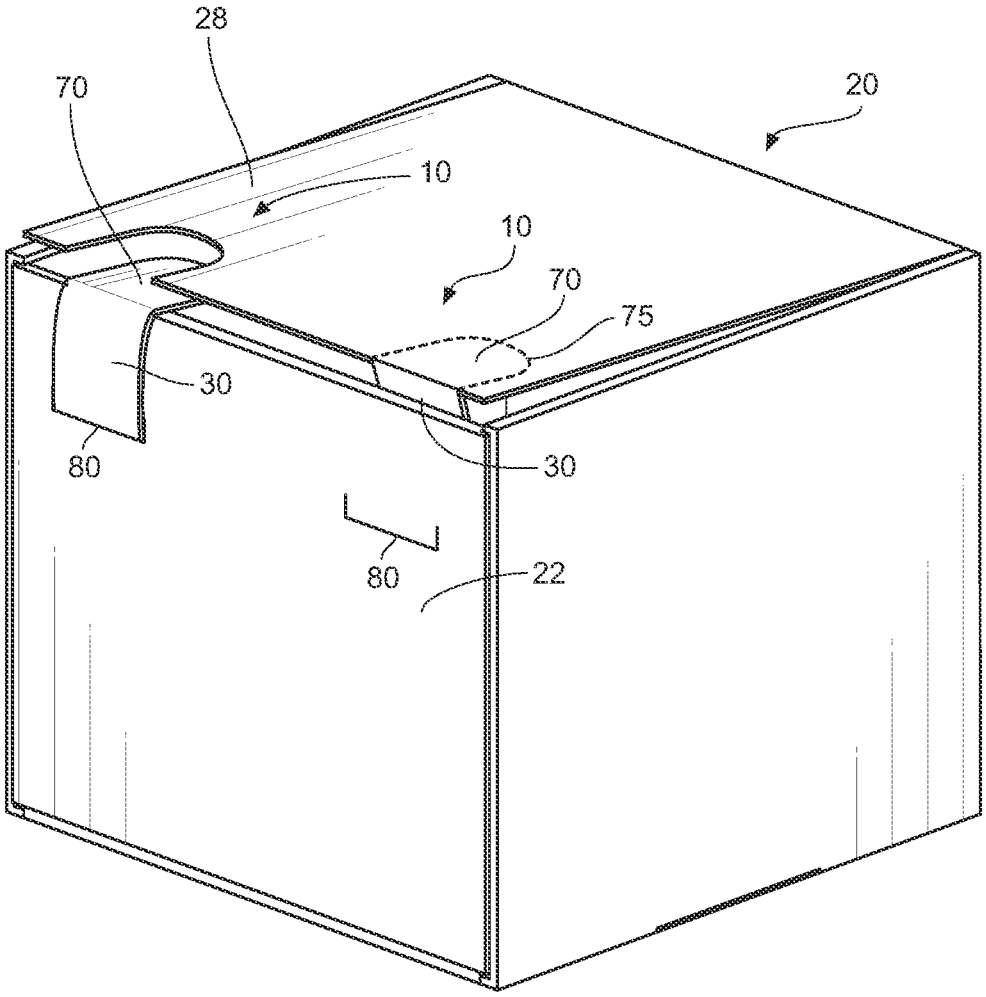
FIG. 11 is a perspective view of the fourth embodiment of the invention, illustrating the first of the locking arrangements as unlocked by separation of the frangible portion at its perforation from the lid of the container, the second of the locking arrangements now able to be subsequently used when desired to again lock the lid of the container in the closed position.
Figure 12:
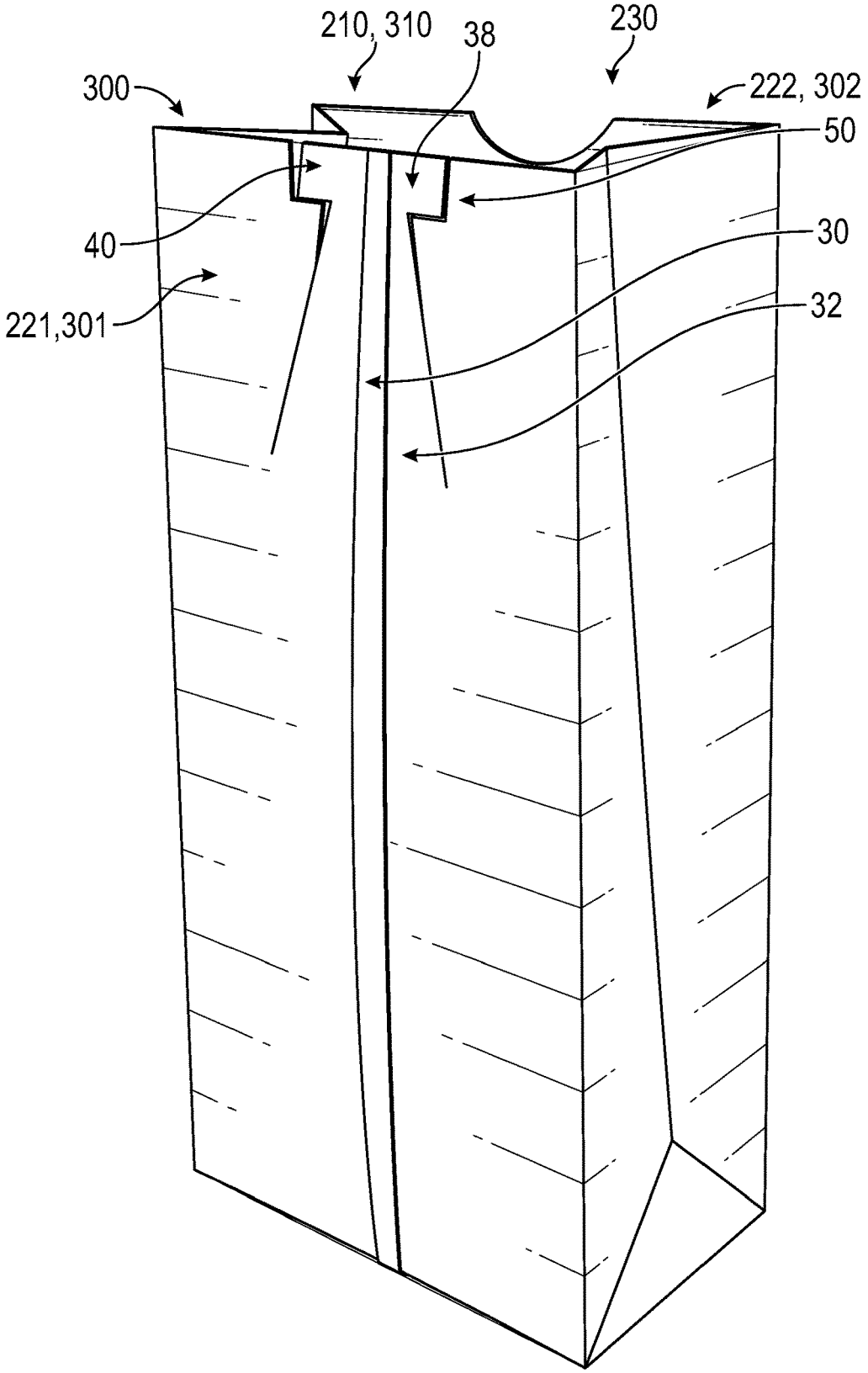
FIG. 12 is a front perspective view of an embodiment wherein the container is a paper bag, illustrated in an open configuration.
Figure 13:
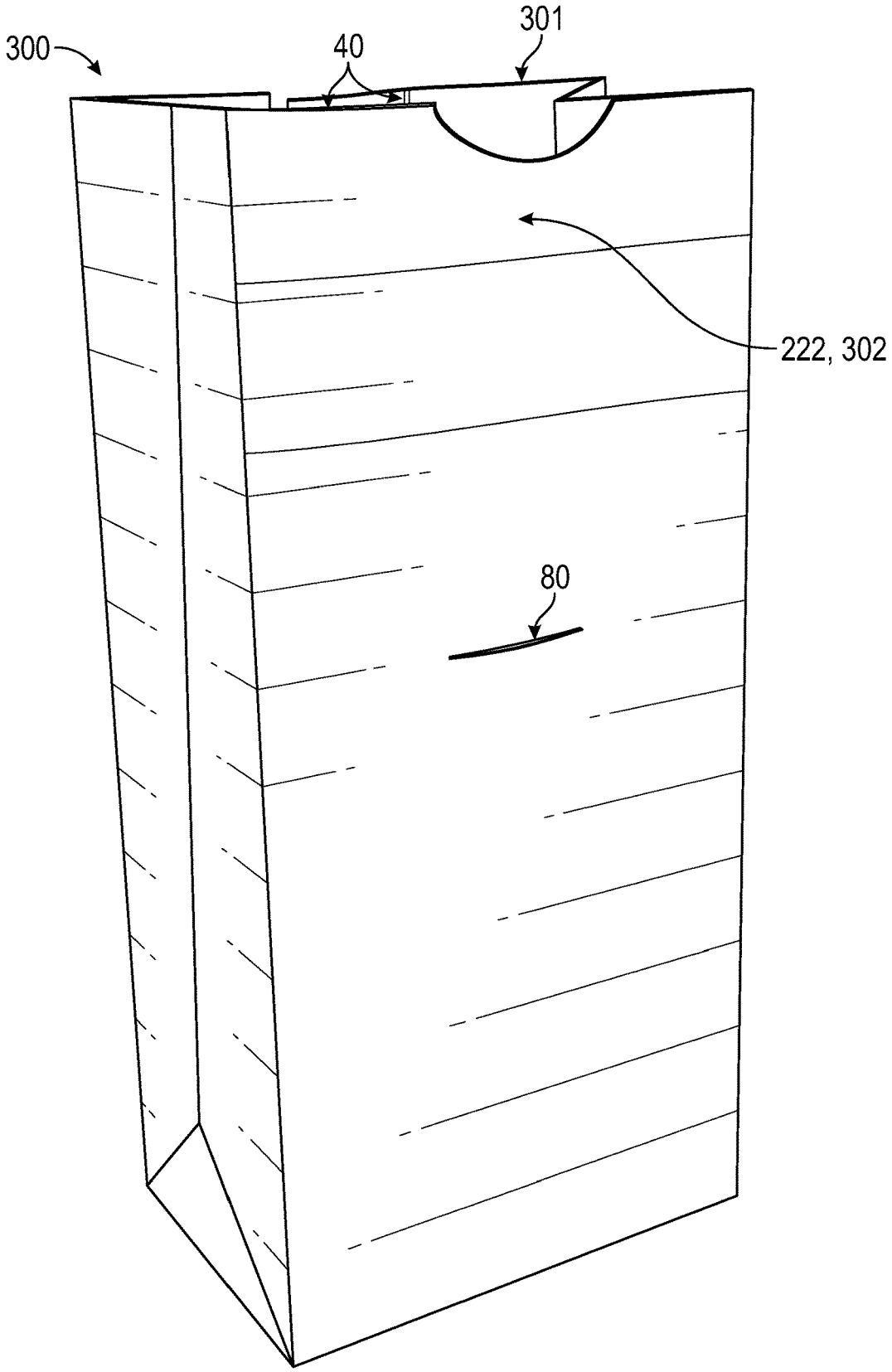
FIG. 13 is a rear perspective view thereof.
Figure 14:
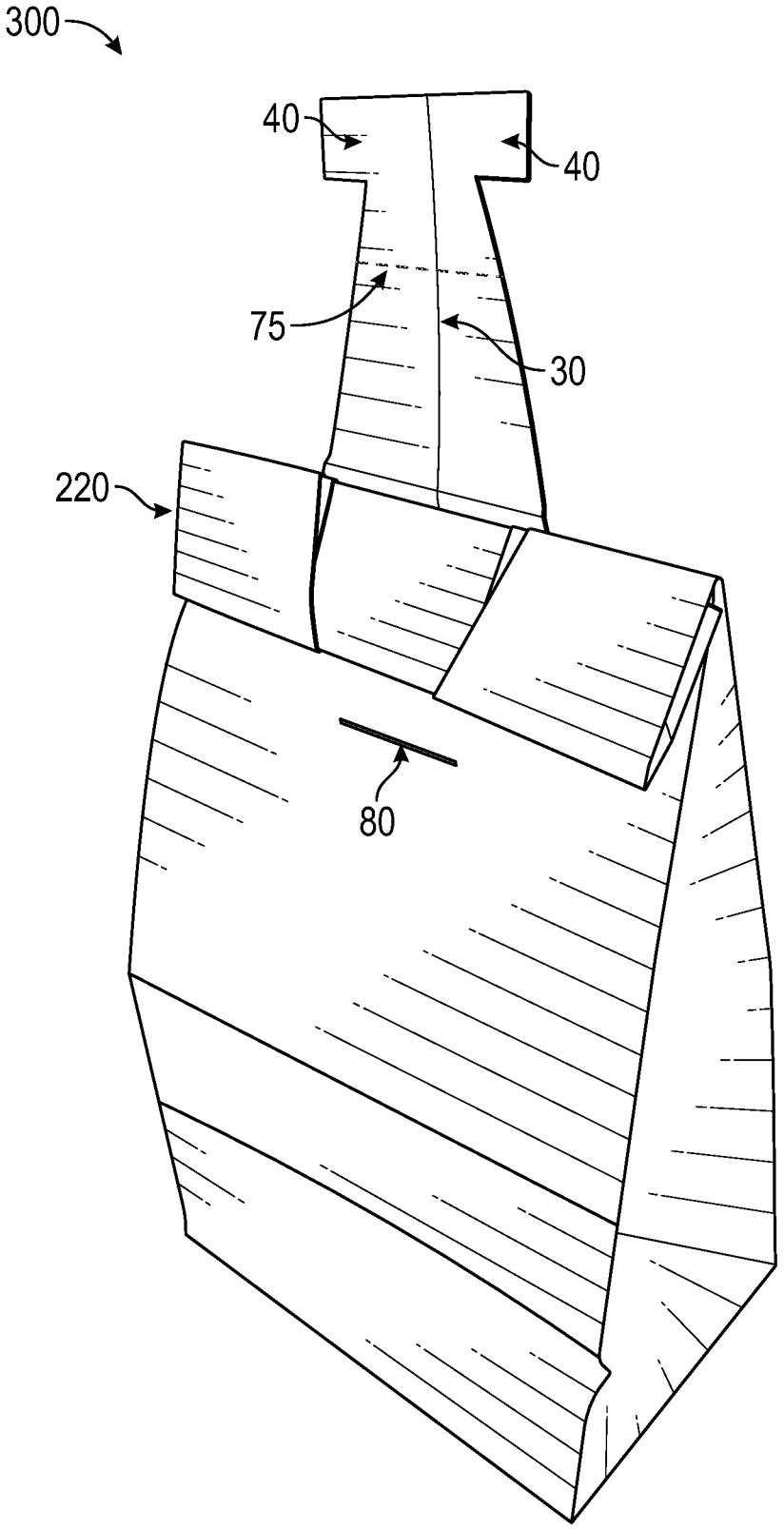
FIG. 14 is a rear perspective view thereof, illustrating a first part and a second part of the container brought together and folded down, the tab and two flaps of the first part remaining flat with the first part.

FIG. 10 shows another embodiment, in this case different than the pizza box 29, wherein the container 20 includes two of the locking arrangements 10, a first of the locking arrangements 10 shown in a locked position to lock the box lid 28 in the closed position, a second of the locking arrangements 10 shown tucked inside the box 20 for future use. FIG. 11 shows the first of the locking arrangements 10 as unlocked by separation of the frangible portion 70 at its perforation 75 from the lid 28 of the container 20, the second of the locking arrangements 10 now able to be subsequently used when desired to again lock the lid 28 of the container 20 in the closed position.

Such a second of the locking arrangements 10 is useful when, for example, upon delivery of food items (not shown) wherein the first of the locking arrangements 10 is locked, and upon opening of the container 20 and eating a portion of the food items, the second of the locking arrangements 10 may be engaged with the slot 80 to subsequently lock the box 20 a second time, so as to prevent roommates or others from accessing the leftover food items of the box 20 without leaving evidence of such, which includes the detached frangible portion 70 of the second of the locking arrangements 10.

In its most general form, the locking arrangement 10 includes the container 20 that has an internal space 200 within, an opening 210, and a closure 220 for the opening 210 that has a first part 221 and a second part 222. The closure 220 is movable between an open configuration 230, allowing access to the internal space 200 of the container 20, and a closed configuration 240 for sealing the container 20. In the embodiment wherein the container 20 is the pizza box 90, the first part 221 of the pizza box 90 is the lid 28. The second part 222 of the pizza box 90 is the peripheral wall 22.

The flap 30 is pivotally attached at the first end 32 thereof to the first part 221. The flap 30 has the at least one tab 40 projecting laterally away from the second end 38 of the flap 30. The flap 30 and the at least one tab 40 are formed from the first part 221 of the container 20.

The slot 80 is formed through the second part 222 of the container 20 and aligned and sized to accept the second end 38 of the flap 30 when the at least one tab 40 is in the folded position 60 and when the closure 220 is in the closed configuration 240.

As such, with the closure 220 of the container 20 in the closed configuration 240, and with the at least one tab 40 in the folded position 60, the flap 30 and the at least one tab 40 can be inserted through the slot 80 from the outside surface 23 of the container 20 through to the internal space 200 of the container 20. Thereafter, as the at least one tab 40 clears the slot 80, the resilient material of the container 20 urges the at least one tab 40 into the expanded position 50. The width $W_{F+T}$ of the flap 30 and the at least one tab 40 are greater than the width $W_S$ of the slot 80 to prevent subsequent removal of the flap 30 and the at least one tab 40 from the slot 80. The closure 220 is openable an open configuration 230 when the at least one tab 40, possibly with a portion of the flap 30, is separated from the first part 221 of the container 20.

Figure 15:
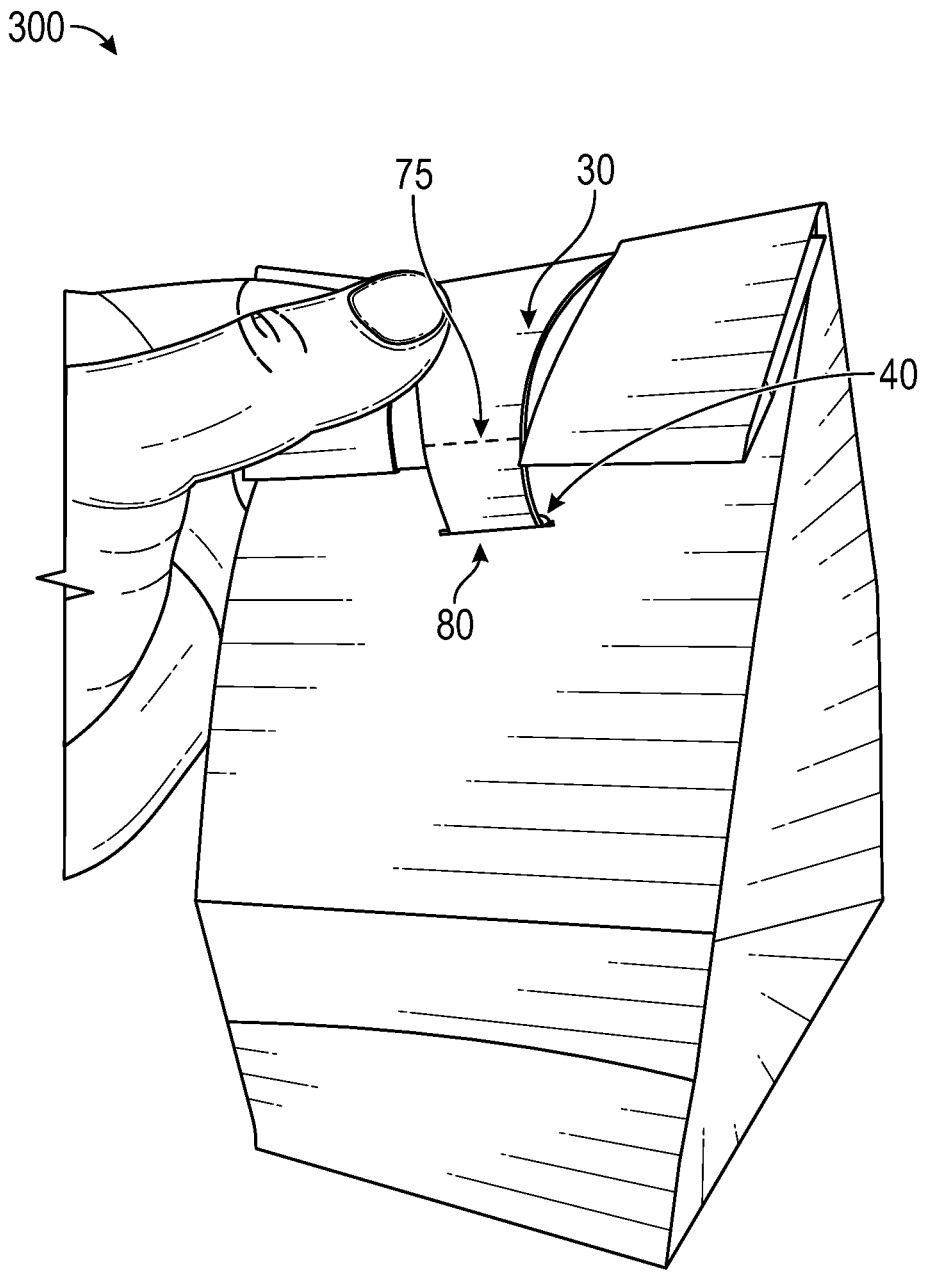
FIG. 15 is a rear perspective view thereof, illustrating the flap and tabs folded and as being inserted into the slot of the second part of the container.
Figure 16:
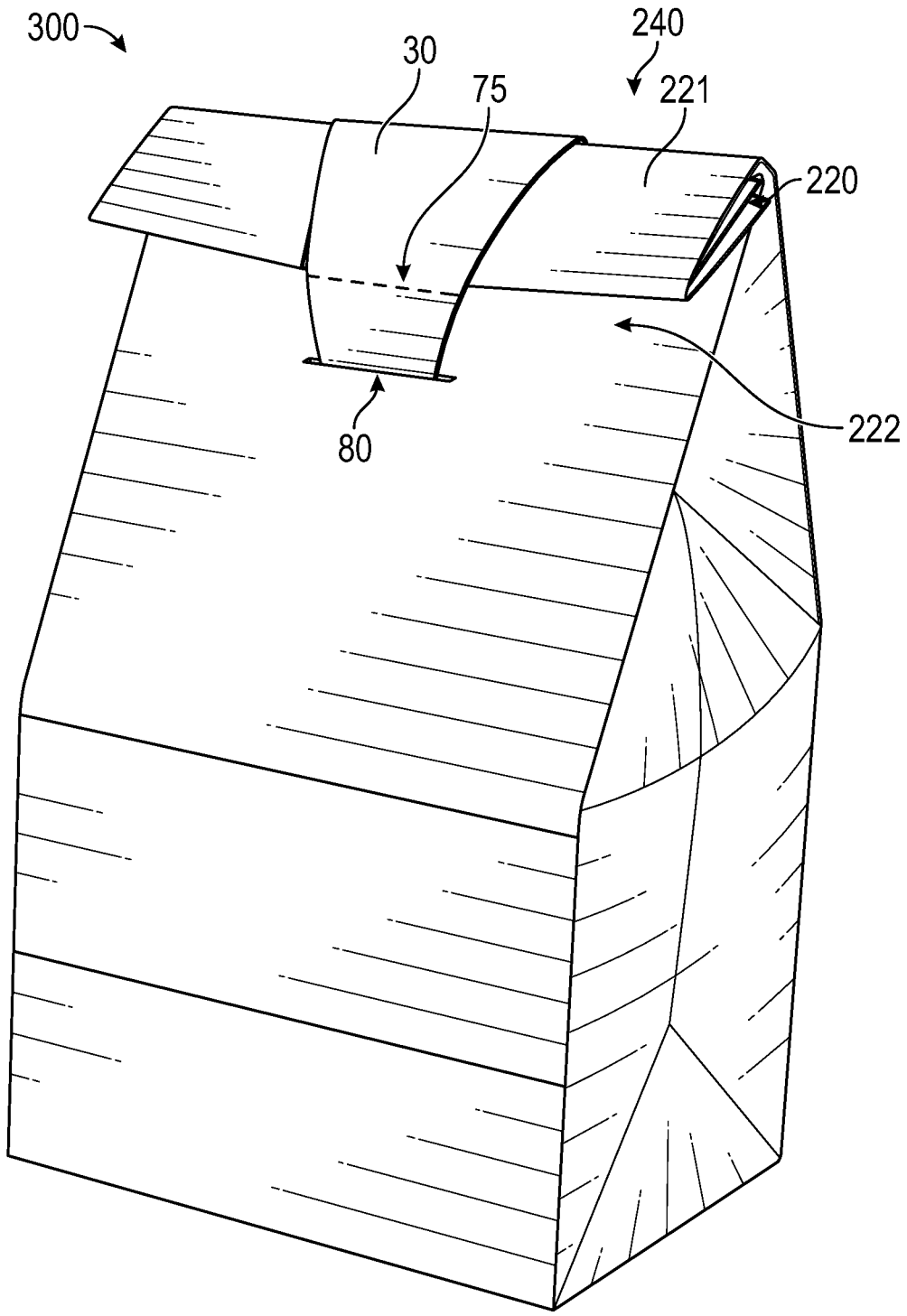
FIG. 16 is a rear perspective view thereof, illustrating the paper bag locked in the closed configuration.
Figure 17:
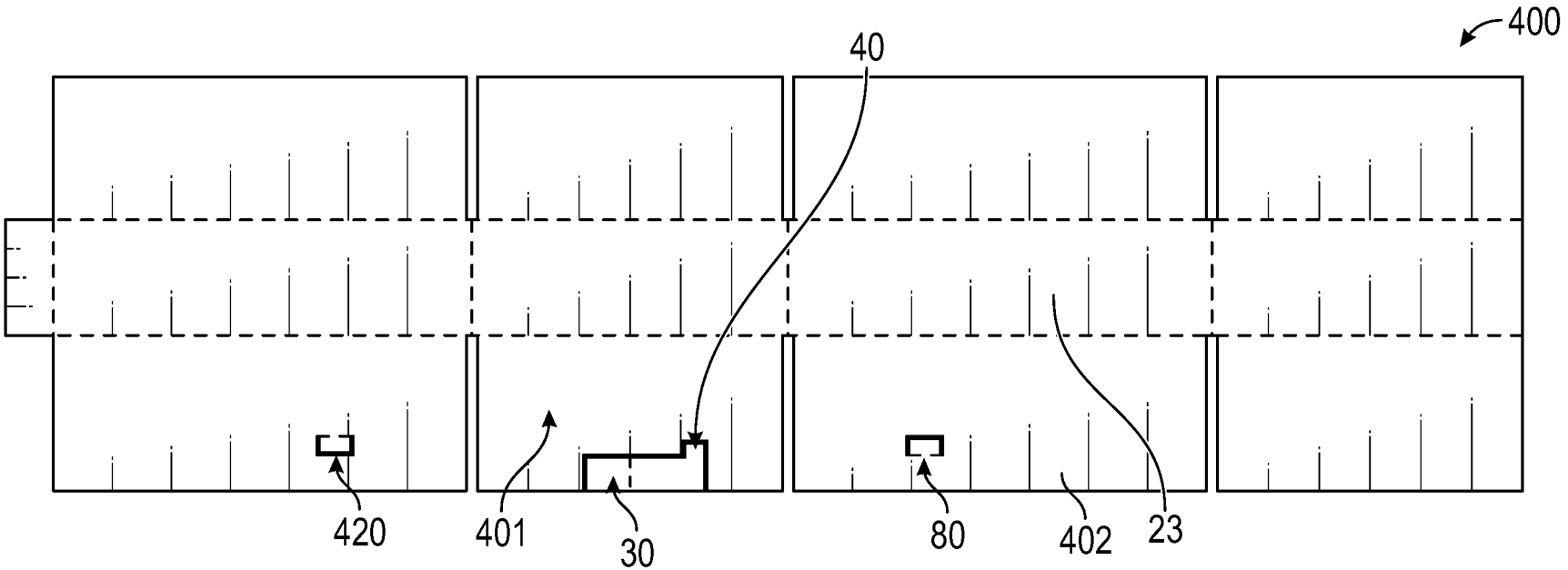
FIG. 17 is a top plan view of an embodiment wherein the container is a shipping box, the shipping box shown in a flat configuration before assembly.

FIGS. 12-16 illustrate an embodiment wherein the container is a paper bag 300 having an open top end 31 with four sides, wherein the first part 221 of the container 20 is a first side 301 of the paper bag 300, and wherein the second part 222 of the container 20 is an opposing second side 302 of the paper bag 300. As such, with the first side 301 of the paper bag 300 and the second side 302 of the paper bag 300 brought together and folded downwardly to form the closure 220 (FIG. 14), the at least one tab 40 can be temporarily folded into the folded position 60 and the flap 30 inserted with the at least one tab 40 into the slot 80 on the second side 302 of the paper bag 300 (FIGS. 15-16). This locks the paper bag 300 in the closed configuration 240 when the at least one tab 40 expands into the expanded position 50 within the internal space 200 of the paper bag 300, due to the resilient material of the paper bag 300. The flap 30 may include the perforation 75 such that tearing the flap 30 at the perforation 75 releases the at least one tab 40 from the first part 221 of the container 20 to allow the paper bag 300 to be opened.

FIGS. 17-20 illustrate an embodiment wherein the container 20 is a shipping box 400 that has an open top end 410 with a first panel 401, a second panel 402 adjacent to the first panel 401, a third panel 403 adjacent the first panel 401 and opposing the second panel 402, and a fourth panel 404 opposing the first panel 401. The first part 221 of the container 20 is the first panel 401 of the shipping box 400 and includes the flap 30 and the at least one tab 40, and the second part 222 of the shipping box 400 is the second panel 402 of the shipping box 400 and includes the slot 80. A through hole 420 is formed in the third panel 403.

Figure 18:
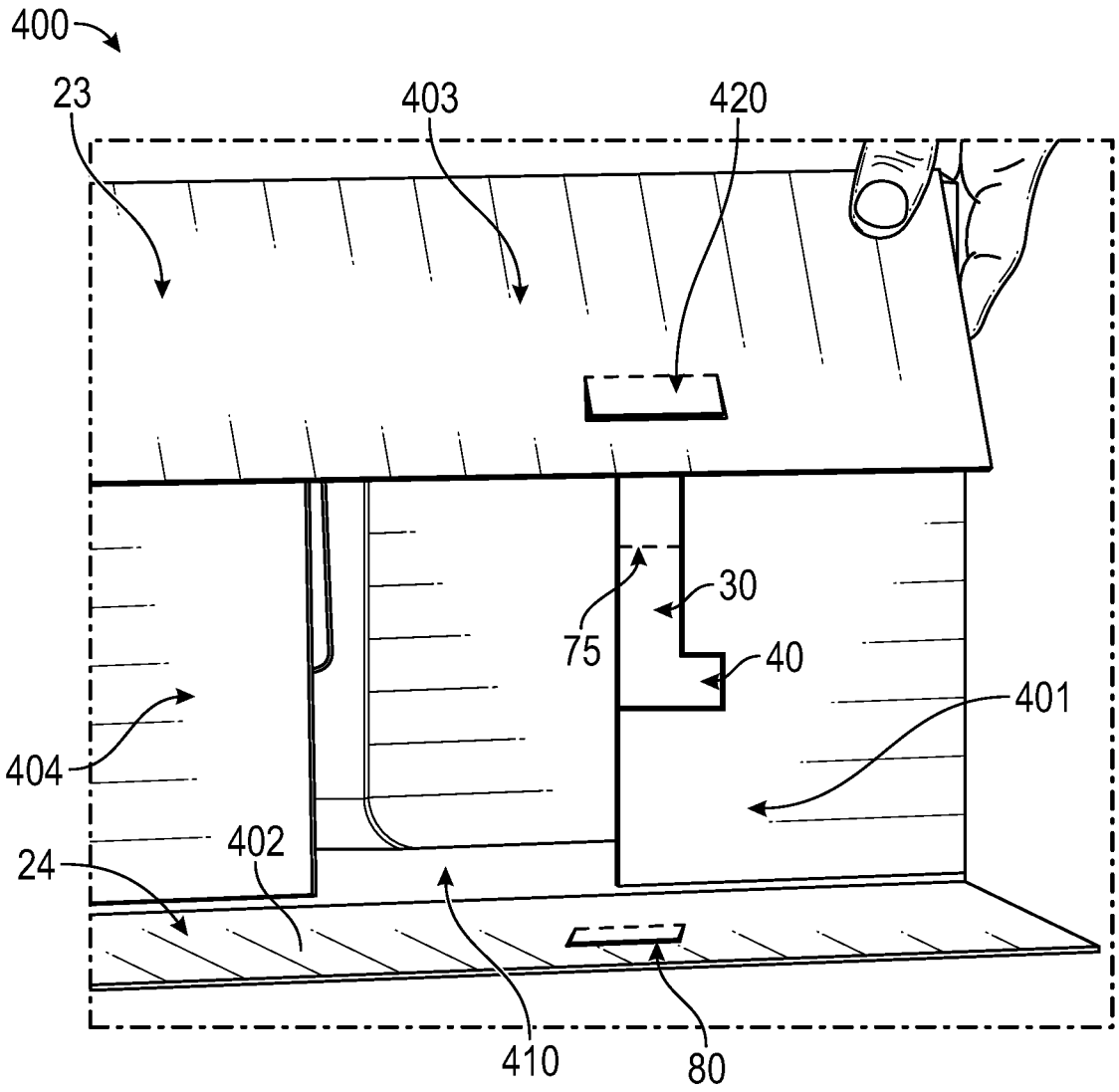
FIG. 18 is a top plan view thereof, showing the shipping box in a folded configuration with an open top end partially closed with panels of the shipping box.
Figure 19:
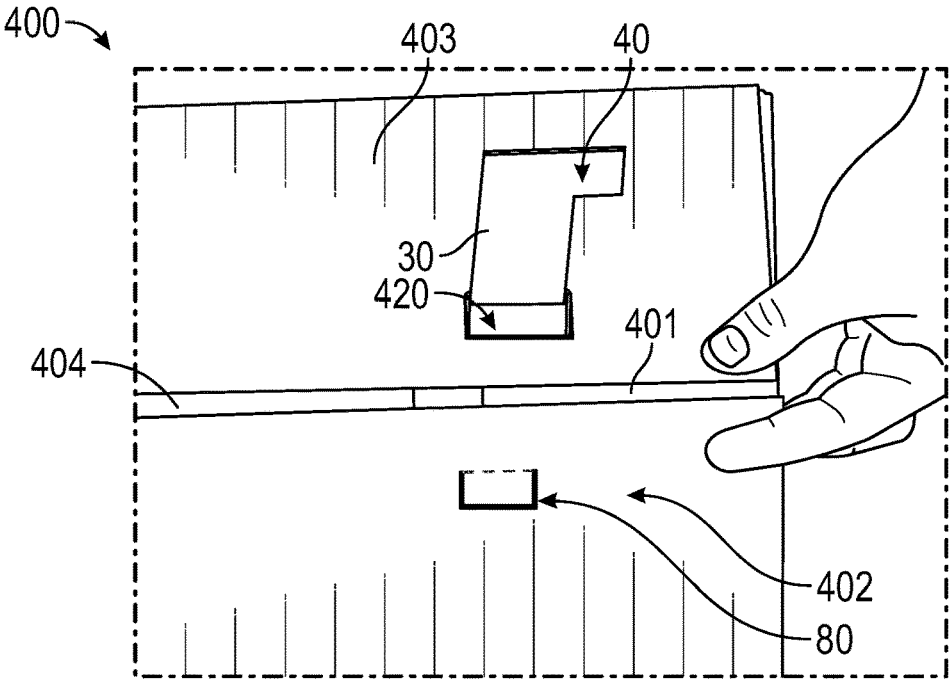
FIG. 19 is a top plan view thereof, showing the tab and flap of a first panel inserted through a through hole of the third panel.
Figure 20:
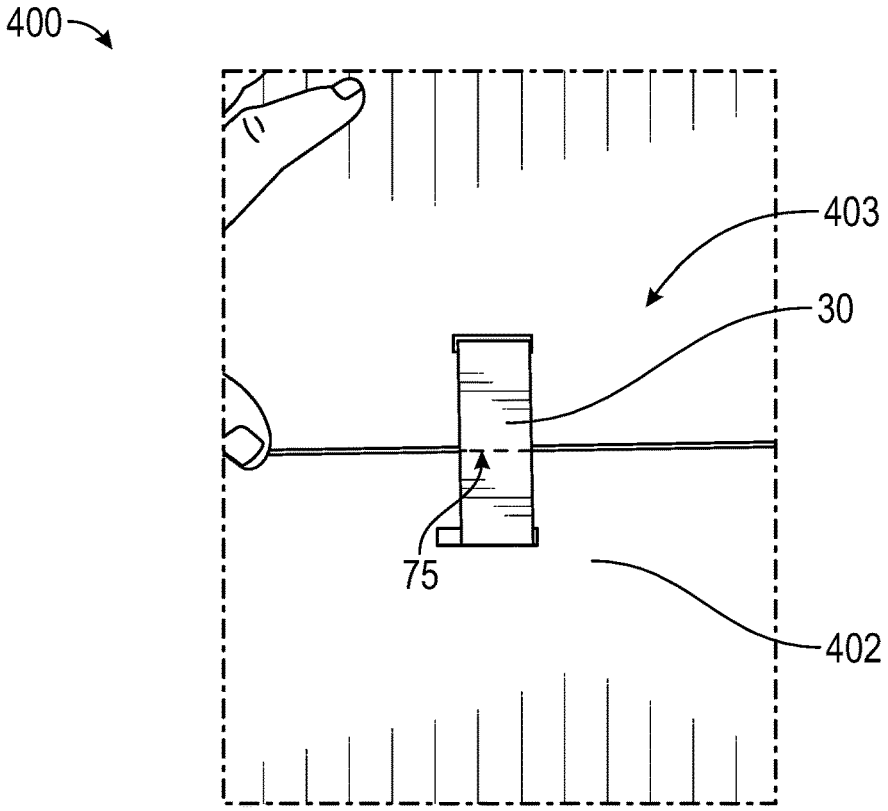
FIG. 20 is a top plan view thereof, showing the tab and flap of the first panel inserted back into the slot of the second panel to lock the shipping box in the closed configuration.
Figure 21:
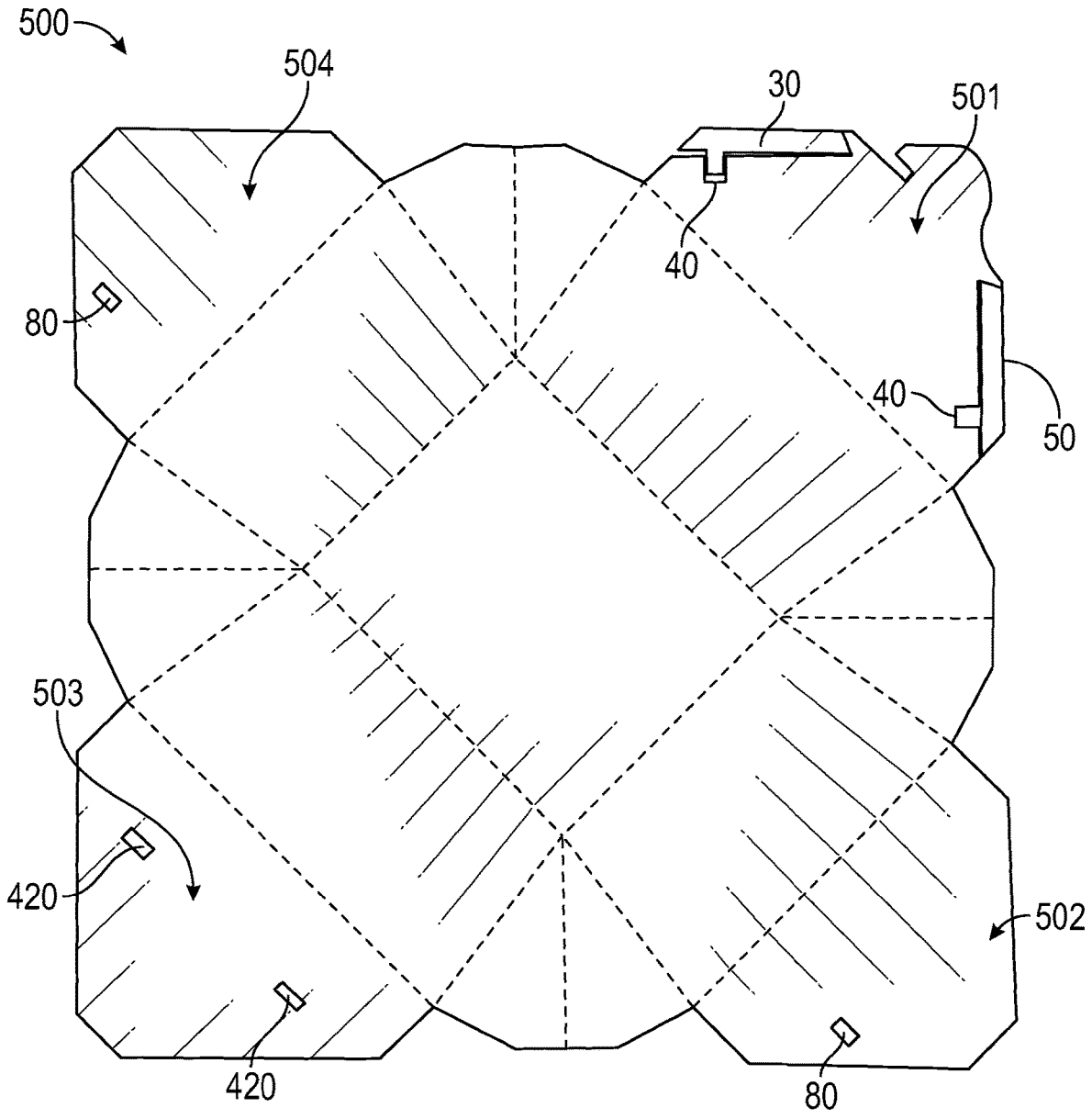
FIG. 21 is a top plan view of an embodiment wherein the container is a food container, the food container shown in a flat configuration before assembly.
Figure 22:
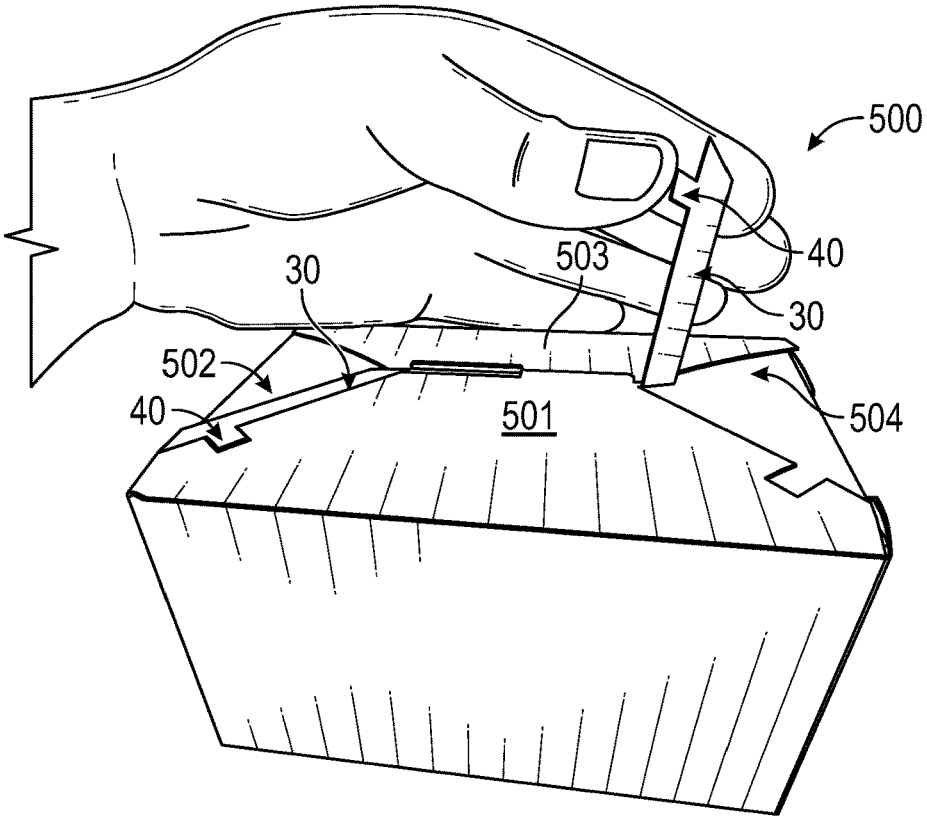
FIG. 22 is a top perspective view thereof, illustrating one of two flaps being prepared for insertion into a through hole of the third panel and then into one of the slots of the fourth panel.
Figure 23:
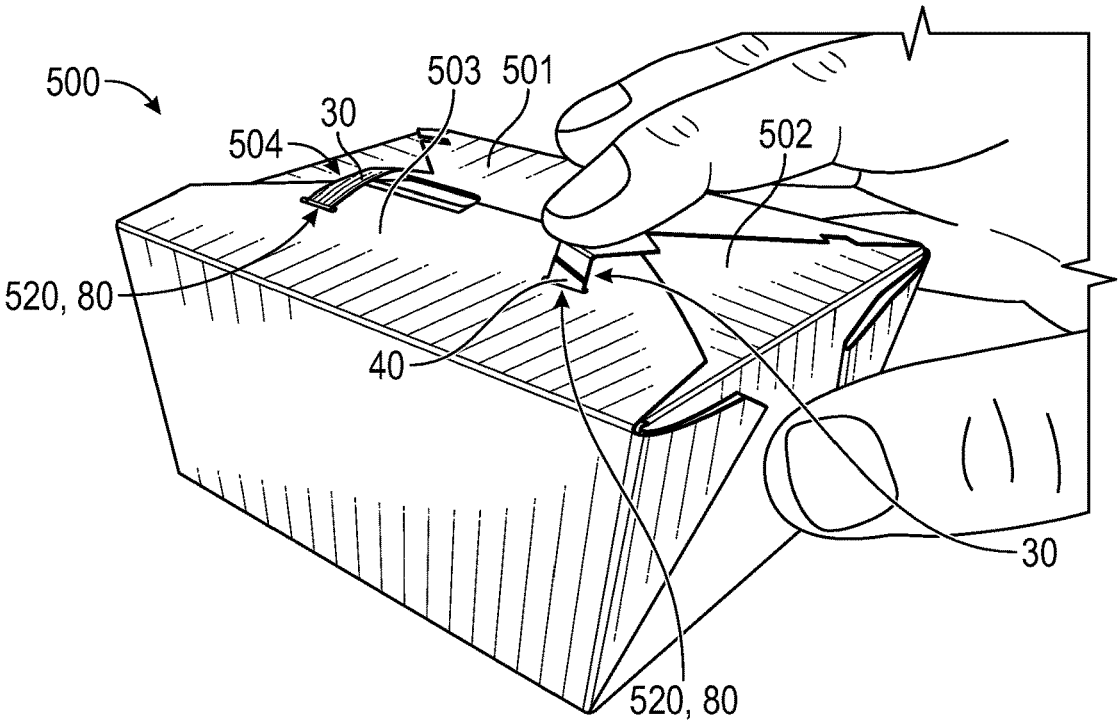
FIG. 23 is a top perspective view of the second flap and tab being inserted into the through hole of the third panel and into the slot of the second panel.
Figure 24:
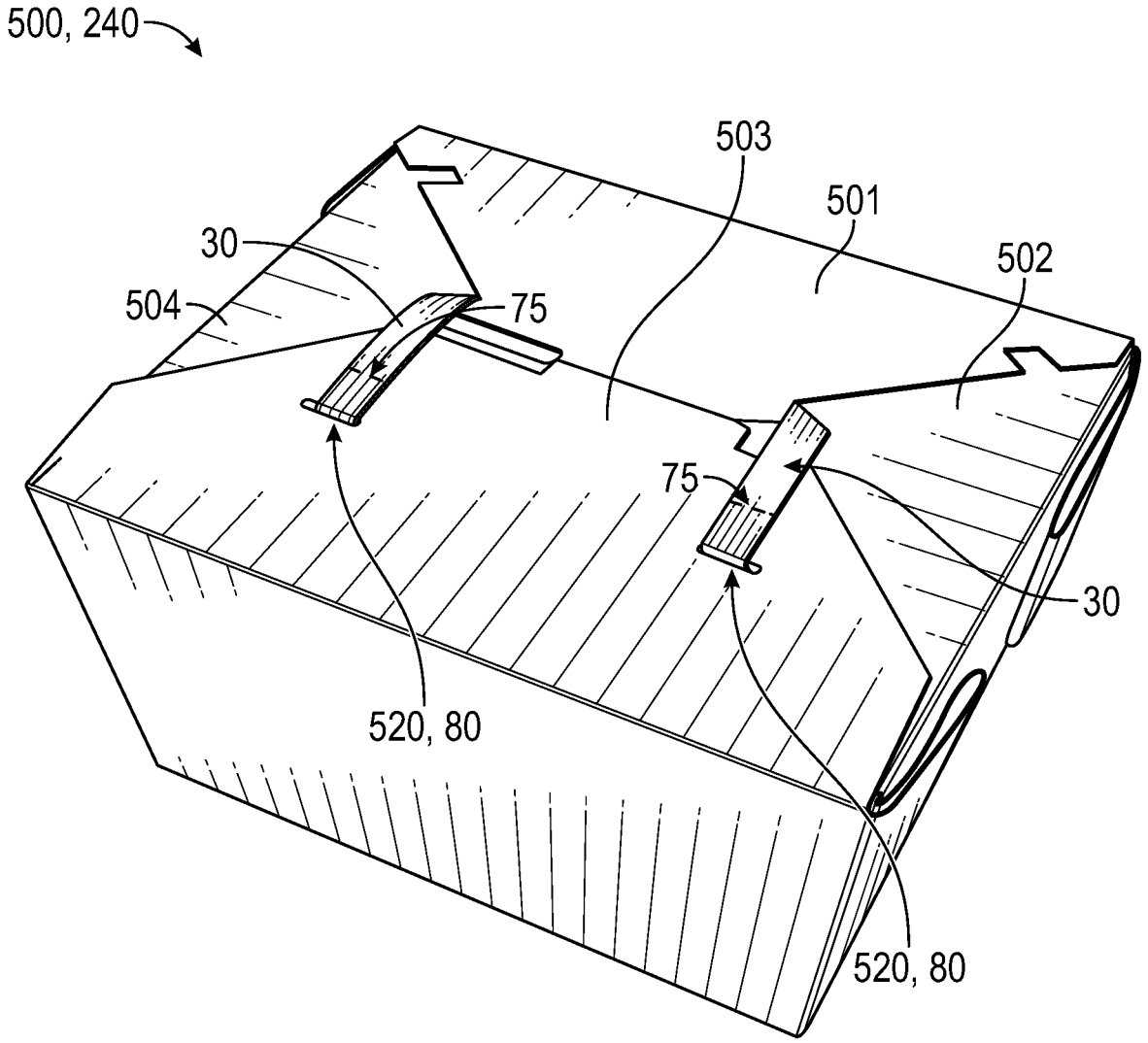
FIG. 24 is a top perspective view thereof, illustrating the food container in the closed configuration and locked by the tabs and flaps.

As such, with the first panel 401 and the fourth panel 404 folded down to cover the open top end 410 of the shipping box 400, the flap 30 with the at least one tab 40 in the folded position 60 is inserted into through hole 420 of the third panel 403 from the inside surface 24 to the outside surface 23, and the third panel 403 is folded downwardly to cover the open top end 410 of the shipping box 400 (FIG. 18). The second panel 402 is then folded down such that the flap 30 and the at least one tab 40 can be inserted into the slot 80 of the second panel 402 (FIGS. 19-20). The shipping box 400 is thereby locked in the closed configuration 240 as the at least one tab 40 expands into the expanded position 50 within the internal space 200. The shipping box 400 is thereafter openable by tearing the flap 30. The flap 30 may include the perforation 75 such that tearing the flap 30 at the perforation 75 releases the at least one tab 40 from the first part 221 of the container 20 to allow the shipping box 400 to be placed in the open configuration 230.

FIGS. 21-24 illustrate an embodiment wherein the container 20 is a food container 500 have an open top end with a first panel 501, a second panel 502 adjacent to the first panel 501, a third panel 503 opposing the first panel 501, and a fourth panel 504 opposing the second panel 502. The first part 221 of the container 20 is the first panel 501 of the food container 500, and the second part 222 of the container 20 is the second panel 502 and the fourth panel 504 of the food container 500. A through hole 520 is formed in the third panel 503.

As such, with the second panel 502 and the fourth panel 504 folded down to cover at least a portion of the open top end of the food container 500, and then the third panel 503 and the first panel 501 folded down, two of the flaps 30 of the first panel 501 each with the at least one tab 40 in the folded position 60 are inserted into one of the through holes 520 of the third panel 503, and then into one of the slots 80 of either the second panel 502 or the fourth panel 54 located directly under the through holes 520. The food container 500 is thereby locked in the closed configuration 240, and openable by tearing each of the flaps 30.

While a particular form of the invention has been illustrated and described, it will be apparent that various modifications can be made without departing from the spirit and scope of the invention. For example, generally rectanguloid containers 20 are shown in the figures, but other shapes of containers 20 could also be locked with the locking arrangement 10. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms.

Accordingly, the inventor reserves the right to add additional claims after filing the application to pursue such additional claim forms for other aspects of the invention.

What is claimed is:

1. A locking arrangement for a container having an outside surface and an inside surface, an internal space, an opening, and a closure for the opening that has at least a first part and a second part, the closure movable between an open configuration allowing access to the internal space of the container, and a closed configuration for sealing the container, the container made with a resilient material, the locking arrangement comprising:

a flap pivotally attached at a first end thereof to the first part, the flap having at least one tab projecting laterally away from a second end thereof, the at least one tab movable between an expanded position and a folded position, the flap formed from the first part;

a slot formed through the second part and aligned and sized to accept the second end of the flap when the tab is in the folded position and when the closure is in the closed configuration; whereby with the closure of the container in the closed configuration, and with the at least one tab in the folded position, the flap and the at least one tab can be inserted through the slot from the outside surface of the container through to the internal space of the container, thereafter as the at least one tab clears the slot the resilient material urges the at least one tab into the expanded position, a width of the flap and the at least one tab being greater than a width of the slot to prevent subsequent removal of the flap and the at least one tab from the slot, the closure openable when the at least one tab is separated from the first part of the container, wherein the flap is frangibly connected to the first part of the container at a perforation, whereby the flap and the at least one tab are removable from the first part of the container by tearing the perforation.

2. The locking arrangement of claim 1 wherein the container is a pizza box, the first part of the pizza box being a lid with at least one peripheral edge, the lid pivotally attached with a base that includes at least one upwardly-projecting peripheral wall, the peripheral wall being the second part of the container, a frangible portion of the lid defined by the perforation that encompasses the first end of the flap, whereby with the flap and the at least one tab engaged with the slot in the at least one upwardly-projecting peripheral wall, the container lid is openable when the frangible portion of the lid is separated from the lid at the perforation, the frangible portion, flap and the at least one tab captured by the slot as the lid is opened.

3. The locking arrangement of claim 2 wherein the lid is pivotally attached to the base at a rear peripheral edge thereof, and wherein the flap, the at least one tab, and frangible portion are formed at a front peripheral edge of the lid, and wherein the slot is formed in a front upwardly-projecting peripheral wall.

4. The locking arrangement of claim 2 wherein the perforation of the frangible portion is U-shaped.

5. The locking arrangement of claim 2 wherein the perforation of the frangible portion is shaped in a semicircle.

6. The locking arrangement of claim 2 wherein the frangible portion of the lid is separated from the lid at the perforation by pressing the frangible portion into the container.

7. The locking arrangement of claim 2 wherein the container is of the type wherein the base includes at least one upwardly-projecting folded peripheral wall having an outside section, an upper edge section, and an inside section, the slot formed through the upper edge section of the at least one upwardly-projecting folded peripheral wall, and an aperture formed through the inside section of the at least one upwardly-projecting folded peripheral wall, the aperture larger in at least one dimension than the tab;

whereby with the lid of the container in a closed position, with the tab in the folded position the flap and tab are inserted through the slot, thereafter as the tab clears the aperture of the inside section of the at least one upwardly-projecting folded peripheral wall, the resilient material urges the tab into the expanded position through the aperture, a width of the flap and the tab being greater than a width of the slot to prevent subsequent removal of the flap and tab from the slot, the container lid openable when the frangible portion of the lid is separated from the lid at the perforation, the frangible portion, flap and tab captured by the slot as the lid is opened.

8. The locking arrangement of claim 7 wherein the container is a pizza box.

9. The locking arrangement of claim 7 wherein the lid is pivotally attached to the base at a rear peripheral edge thereof, and wherein the flap, tab and frangible portion are formed at a front peripheral edge of the lid, and wherein the slot is formed in a front upwardly-projecting peripheral wall.

10. The locking arrangement of claim 1 wherein the container is a paper bag having an open top end with four sides, wherein the first part of the container is a first side of the paper bag and wherein the second part of the container is an opposing second side of the paper bag, whereby with the first side of the paper bag and the second side of the paper bag brought together and folded downwardly, the at least one tab can be temporarily folded into the folded position and the flap inserted into the slot on the second side of the paper bag to lock the bag in the closed configuration when the at least one tab expands into the expanded configuration, bag openable by tearing the flap.

11. The locking arrangement of claim 10 wherein the flap is frangibly connected to the first side of the bag at a perforation, whereby the at least one tab and at least a portion of the flap are removable from the first side of the bag by tearing the perforation.

12. The locking arrangement of claim 1 wherein the container is a shipping box having an open top end with a first panel, a second panel adjacent the first panel, a third panel opposing the second panel, and a fourth panel opposing the first panel, wherein the first part of the container is the first panel of the shipping box and wherein the second part of the container is the second panel of the shipping box, a through hole formed in the third panel, whereby with the first panel and the fourth panel folded down to cover the open top end of the shipping box, the flap with the at least one tab in the folded position is inserted into the through hole of the third panel, the third panel folded downwardly, the second panel then folded down such that the flap and the at least one tab are inserted into the slot of the second panel, the shipping box thereby being locked in the closed configuration, the shipping box openable by tearing the flap.

13. The locking arrangement of claim 12 wherein the flap includes a perforation, whereby the shipping box openable by tearing the flap at the perforation.

14. The locking arrangement of claim 1 wherein the container is a food container having an open top end with a first panel, a second panel adjacent the first panel, a third panel opposing the first panel, and a fourth panel opposing the second panel, wherein the first part of the container is the first panel of the food container and wherein the second part of the container is both the second panel and the fourth panel of the food container, two through holes formed in the third panel, whereby with the second panel and the fourth panel folded down to cover at least a portion of the open top end of the food container, and then with the third panel and the first panel folded down, two of the flaps of the first panel each with the at least one tab in the folded position are inserted into one of the through holes of the third panel, and immediately thereafter into one of two of the slots of either the second panel or the fourth panel, the food container thereby being locked in the closed configuration when the at least one tab of each flap expands into the expanded configuration, the food container openable by tearing each flap.

15. The locking arrangement of claim 14 wherein each flap includes a perforation, whereby the food container is openable by tearing each flap at the perforation.

* * * * *